US005182534A

United States Patent [19]

Hara

[11] Patent Number: 5,182,534

[45] Date of Patent: Jan. 26, 1993

[54] SHEET GUIDING APPARATUS AND AN IMAGE FORMING APPARATUS USING SAME

[75] Inventor: Yoshinobu Hara, Shinshiro, Japan

[73] Assignee: Minolta Camera Kabushiki Kaisha, Osaka, Japan

[21] Appl. No.: 787,798

[22] Filed: Nov. 4, 1991

[30] Foreign Application Priority Data

Nov. 5, 1990 [JP] Japan ..... 2-300489

[51] Int. Cl.[5] ..... G30G 21/00

[52] U.S. Cl. ..... 355/316; 271/272; 355/311; 355/317

[58] Field of Search ..... 271/272; 162/271; 493/459; 355/309, 311, 316, 317

[56] References Cited

U.S. PATENT DOCUMENTS

| | | | |
|---|---|---|---|
| 4,101,212 | 7/1978 | Sumiyoshi et al. | 355/274 |
| 4,391,510 | 7/1983 | Cherian | 355/317 |
| 4,484,737 | 11/1984 | Sugiyama | 355/309 X |
| 4,708,456 | 11/1987 | Shibata et al. | 355/309 |
| 4,862,215 | 8/1989 | Nomura et al. | 162/271 X |

FOREIGN PATENT DOCUMENTS

| | | |
|---|---|---|
| 56-5575 | 1/1985 | Japan . |
| 60-19167 | 1/1985 | Japan . |
| 63-301982 | 12/1988 | Japan . |

*Primary Examiner*—A. T. Grimley
*Assistant Examiner*—P. J. Stanzione
*Attorney, Agent, or Firm*—Burns, Doane, Swecker & Mathis

[57] ABSTRACT

A sheet guiding apparatus and an image forming apparatus incorporating same. The copy sheet being transported to the transfer station by a pair of feed rollers is guided by a pair of guide panels arranged in one direction and an opposite direction. These guide panels are located in an extension state with a substantial intervening spacing at the moment transport starts, and are located in a contracted state with a narrow intervening spacing at the completion of sheet transport so as to prevent transport error and transfer dislocation. The timing by which the guide panels change form the extension state to the contraction state changing in accordance with the copy sheet size to assure guidability regardless of the size of the copy sheet.

23 Claims, 11 Drawing Sheets

SHEET GUIDING APPARATUS AND AN IMAGE FORMING APPARATUS USING SAME

FIELD OF THE INVENTION

The present invention relates to an electrostatic transfer copying machine for forming images on a copy sheet and a sheet guiding apparatus used therein.

BACKGROUND OF THE INVENTION

Electrostatic transfer copying machines that form images on a copy sheet require that the transported copy sheet be accurately guided to the transfer station. Guiding apparatus such as that shown in FIG. 1 are used in conventional copying machines. That is, upper and lower guide panels a and b are disposed between a pair of rollers c and the transfer station d so as to be arranged in one direction and an opposite direction relative to the natural sheet feed path e (the path along the common tangential line through the nip portion of the pair of rollers c) formed by said pair of rollers c. The pair of guide panels a and b are arranged so as to confront one another such that the back ends thereof facing the pair feed rollers are substantially separated from the copy sheet feed path e, and the front ends thereof facing the transfer station converge toward the copy sheet feed path e.

Thus, by substantially separating the back ends of the pair of guide panels a and b, the leading end of the copy sheet g fed from the pair of feed rollers c can be readily received between the pair of guide panels a and b even if the feed direction changes in sheet transport direction caused by changes in material, thickness, curling and direction of curling of the copy sheet g. Since the spacing interval between the front ends of the pair of guide panels a and b is narrow, the received copy sheet g is advanced at a predetermined angle into the sheet transport path e of the image bearing member f and the transfer station d so as to suitably adhere the copy sheet g to the surface of the image bearing member while advancing toward the transfer station d.

In the conventional apparatus shown in FIG. 1, the copy sheet g is transported along the feed path e from the pair of feed rollers, and is forcibly bent from the bottom side as the sheet advances toward the image bearing member f and the transfer station d. Therefore, when the trailing end of the copy sheet g leaves the pair of rollers c, the trailing end of the sheet g becomes free of said pair of rollers and rebounds upwardly in a self-righting action to assume its natural state. The aforesaid upward rebound of the trailing end of the copy sheet g is more pronounced with sheets having greater stiffness due to the material or thickness of the sheet, and produces undulation of the copy sheet g during the transfer. This undulation adversely affects the transfer by causing transfer dislocation, which reduces image quality.

When the spacing interval between the pair of guide panels a and b is narrowed to compensate for the aforesaid undulation, it becomes difficult to receive the copy sheet fed from the pair of rollers c, thereby causing paper jams. In the above description, a spring applies a force on the lower guide panel from the upper guide panel side so allow responsiveness to differences in passage resistance produced by variations in sheet thickness. To allow accurate receiving of the copy sheet sent from the pair of rollers, the back end sides of the pair of guide panels are substantially separated such that the upward rebound of the trailing end of the copy sheet cannot be prevented. Particularly when the trailing end of the copy sheet is released from the pair of rollers and enters the free state, the lower guide panel actively raises the aforesaid trailing end of the sheet and readily undulates due to the action of the spring. Thus, the previously describe disadvantages are not eliminated.

SUMMARY OF THE INVENTION

A main object of the present invention is to provide a sheet guiding apparatus capable of accurately guiding a copy sheet to a transfer station and an image forming apparatus incorporating same.

A further object of the present invention is to provide a sheet guiding apparatus capable of accurately guiding a copy sheet to a transfer station regardless of the sheet size and an image forming apparatus incorporating same.

These objects of the present invention are achieved by providing a sheet guiding apparatus and an image forming apparatus incorporating same to accurately guide the copy sheet to a transfer station by suitably changing the mutual spacing interval between a pair of guide means.

These objects of the present invention are further achieved by providing a sheet guiding apparatus and an image forming apparatus incorporating same wherein the pair of guide means are displaced via a timing corresponding to the copy sheet size.

BRIEF DESCRIPTION OF THE DRAWINGS

In the following description, like parts are designated by like reference numbers throughout the several drawings.

DESCRIPTION OF THE PREFERRED EMBODIMENTS

The first embodiment of the invention is described hereinafter with reference to FIGS. 2 through 13.

Figure 1:
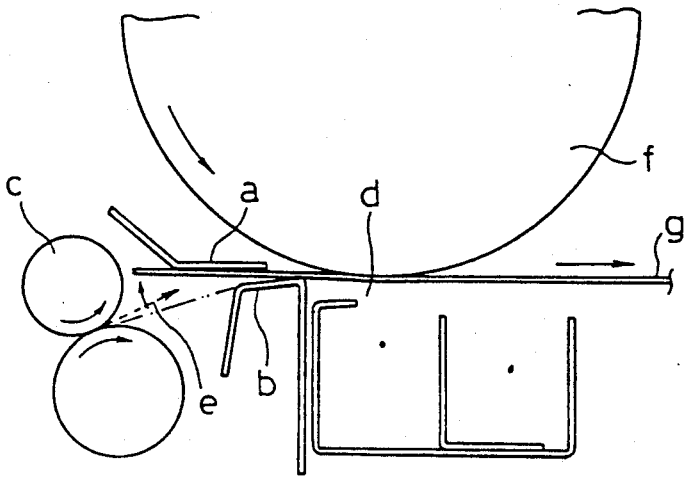
FIG 1 (PRIOR ART)
FIG. 1 is an illustration showing the related art.
Figure 2:
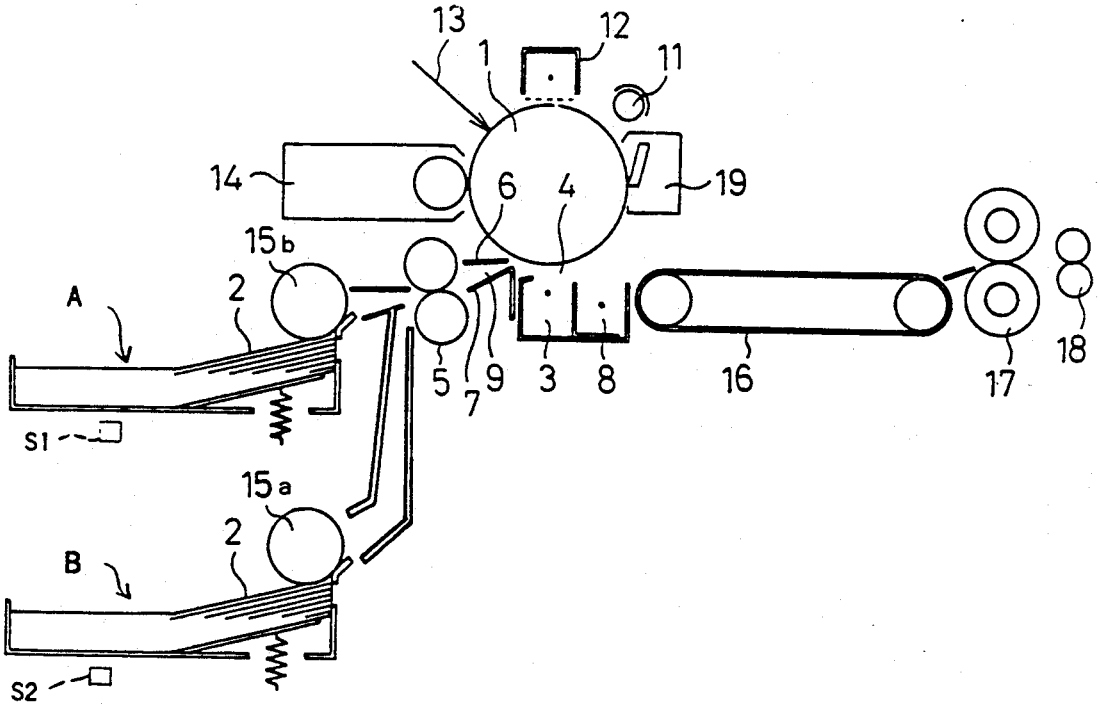
FIG. 2 shows the essential construction of a transfer type image forming apparatus.

FIG. 2 shows the essential construction of an image forming apparatus for forming images by electrostatic transfer. The surface of the photosensitive drum 1 is uniformly charged by means of an eraser lamp 11 and a charger 12, and the charged surface of the drum is exposed to an optical image in the direction of the arrow 13 so as to form an electrostatic latent image thereon. This electrostatic latent image is developed into a toner image by the developing device 14. The developed image on the surface of the photosensitive drum 1 is transferred onto a fed copy sheet 2 by the transfer charger 3, thereby forming the image on the surface of the copy sheet 2. A pair of timing rollers 5 are provided in front of the transfer station 4 that accomplishes the aforesaid image transfer. These timing rollers 5 stop the copy sheet 2 transported thereto by the feed rollers 15*a* and 15*b* of the paper supply portions A and B to correct skewing of the sheet 2 by aligning the leading edge thereof, and the sheet 2 is advanced toward the transfer station 4 with a timing whereby the leading end of the copy sheet 2 and the developed image formed on the surface of the photosensitive drum 1 coincide. After the image transfer, the surface of the photosensitive drum 1 is cleaned by a cleaner 19, then uniformly charged as previously described in preparation for a subsequent image formation.

A pair of guide plates 6 and 7 are provided in the transport path 9 of the copy sheet 2 between the timing rollers 5 and the transfer station 4 so as to guide the copy sheet 2 fed from the timing rollers 5 toward the transfer station 4. A separation charger 8 is disposed downstream from the transfer charger 3 in the sheet transport direction. After the image transfer, the copy sheet 2 is separated from the photosensitive drum 1 and delivered to the fixing unit 17 via a conveyor 16, and after the fixing process the sheet 2 is discharged out of the copying machine by a discharge roller 18.

The pair of guide panels 6 and 7 are arranged so that the back ends expand outwardly opposite the timing rollers 5. The copy sheet 2 is advanced by the timing rollers 5 toward the photosensitive drum 1 at a predetermined angle so that the copy sheet 2 is accurately received by the pair of guide panels 6 and 7 and smoothly guided toward the transfer station 4 even if the feed direction changes in sheet transport direction caused by changes in material, thickness, curling and direction of curling of the copy sheet 2.

The upper guide panel 6 assures the movability of the copy sheet 2 toward the transfer station 4 by restricting the entrance angle when the entrance angle of the copy sheet 2 is very acute, and the lower guide panel 7 assures the adherability of the copy sheet 2 to the surface of the photosensitive drum 1 by increasing the entrance angle of the copy sheet 2 when said entrance angle is very obtuse.

The aforementioned extended state of the back ends of the pair of guide panels 6 and 7 causes the trailing end of the copy sheet 2 to slip free when it separates from the timing rollers 5 so as to rebound upwardly therefrom. In order to prevent the trailing end of the copy sheet 2 from rebounding upward, the pair of guide panels 6 and 7 are moved to positions that converge toward the natural sheet feed path 21 from the timing rollers 5 so as to narrow the spacing between said guide panels 6 and 7 within a predetermined interval which spans at least from immediately prior to the separation of the trailing end of the sheet 2 from the timing rollers until the passage of said trailing end of sheet 2 between the pair of guide panels 6 and 7.

Figure 3:
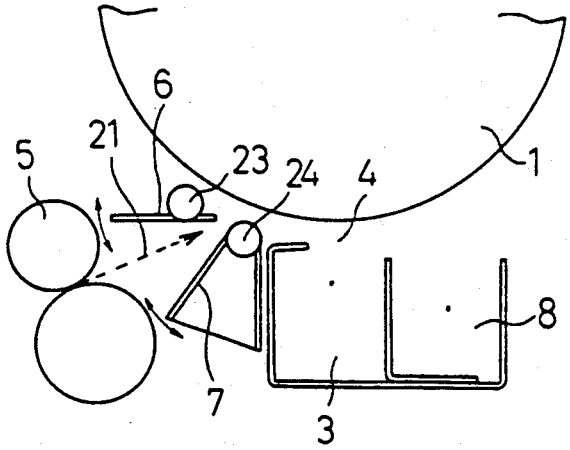
FIG. 3 is an illustration describing the operation of the upper guide panel.
Figure 4:
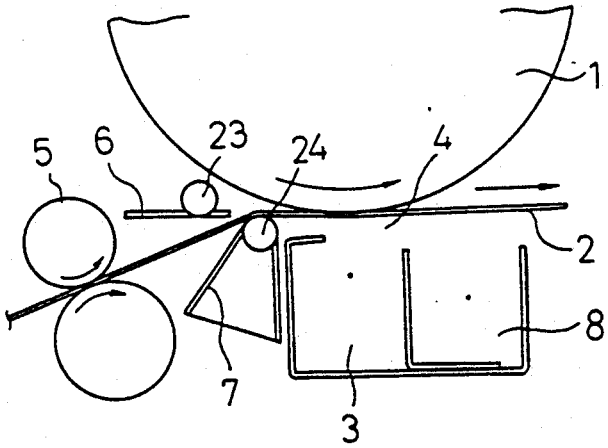
FIG. 4 shows the extended state of the upper guide panel.
Figure 5:
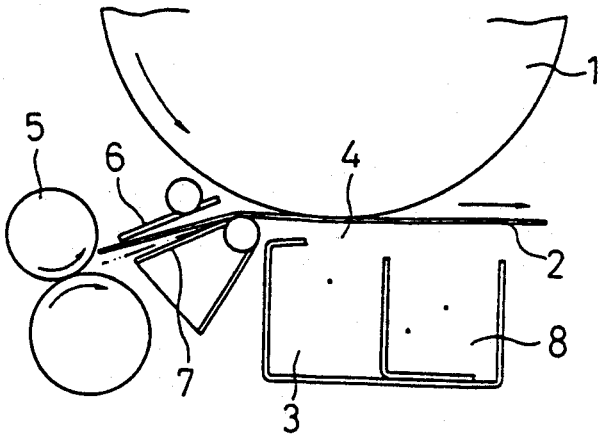
FIG. 5 shows the contracted state of the upper guide panel.
Figure 6:
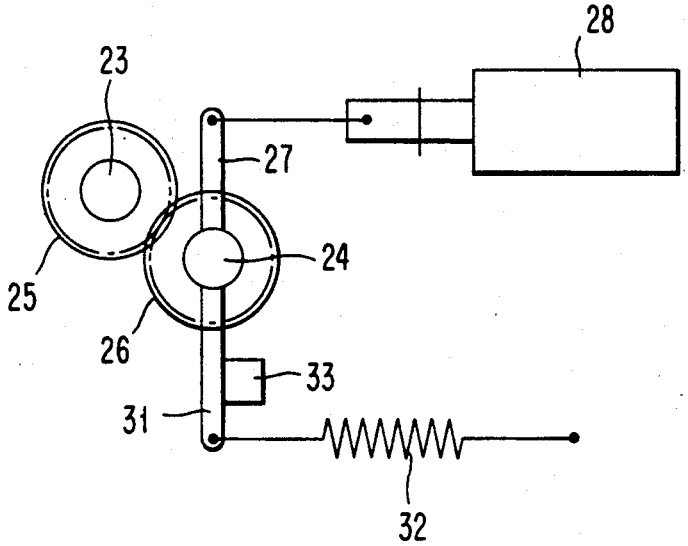
FIG. 6 is a lateral view of the drive mechanism of the pair of guide panels.

A more specific description of the aforesaid arrangement follows. The front ends of the guide panels 6 and 7 confronting the transfer station 4 are rotatably supported by the shafts 23 and 24, as shown in FIGS. 3 through 5. These shafts 23 and 24 are linked via the gears 25 and 26, as shown in FIG. 6, and one end of the shaft 24 is connected to the solenoid 28 via an armature 27. A spring 32 operates on the shaft 24 via an armature 31, such that the shafts 23 and 24 can be stabilized at a rotational position when the armature 31 abuts the stopper 33.

The aforesaid stabilized state is achieved by switching off the solenoid 28. In the stabilized state, the upper guide panel 6 locates at the first position and the lower guide panel 7 locates at the fourth position, as shown in FIGS. 3 and 4. The guide panels 6 and 7 are thus, positioned so as to be substantially separated from the sheet transport path 21 along the common tangential line of the timing rollers 5.

On the other hand, when the solenoid 28 is switched on, the shafts 23 and 24 are rotated by the resistance of the spring 32. The pair of guide panels are thereby moved so that the upper guide panel 6 locates at the second position and the lower guide panel 7 locates at the third position as shown in FIG. 5. The guide panels are thus positioned near the sheet feed path 21 along the common tangential line of the timing rollers 5.

Before the leading end of the subsequent copy sheet 2 is fed from the timing rollers 5 and inserted between the pair of guide panels 6 and 7, the spacing interval between the guide panels 6 and 7 return to the extended state, as shown in FIG. 3. Thus, the copy sheet 2 can be accurately guided to the transfer station 4 even if the direction at which the copy sheet 2 is fed from the timing rollers 5 changes due to changes in material, thickness, curling and direction of curling of the copy sheet 2.

Furthermore, the spacing interval between the pair of guide panels 6 and 7 is contracted, as shown in FIG. 5, the moment before the trailing end of the copy sheet 2 separates from the timing rollers 5. Thus, the trailing end of the copy sheet contacts the upper guide panel 6 which prevents said trailing end of the sheet 2 from rebounding upward even when such rebound may be expected due to the natural characteristics of the sheet 2 in the region used for the transfer as said trailing end of the sheet 2 separates from the timing rollers 5. The lower guide panel 7 also supports the trailing end of the copy sheet 2 in proximity to the copy sheet feed path 21 when said sheet 2 has separated from the timing rollers 5, and prevents undulations in the sheet induced by acute drooping of said trailing end of the sheet even such acute drooping of the trailing end may be expected due to a lack of stiffness of said sheet 2. Therefore, transfer dislocation can be eliminated by preventing the undulations that occurs when the trailing end of the copy sheet 2 separates from the timing rollers 5.

Figure 7:
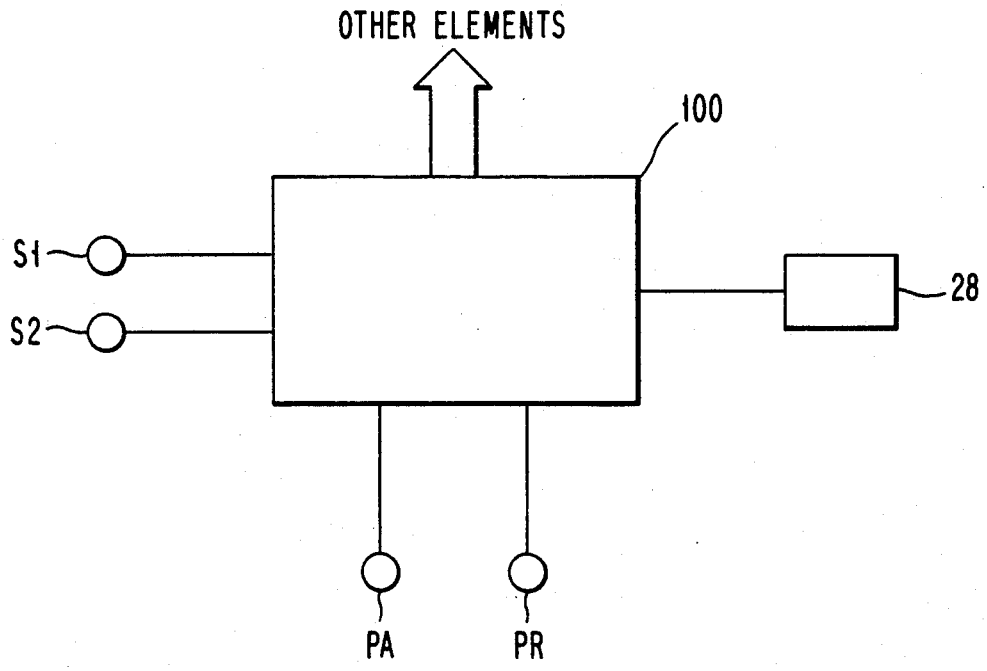
FIG. 7 is an illustration showing the control circuit of the image forming apparatus.

FIG. 7 shows the control circuit of the copying machine. The sheet size detecting sensors S1 and S2, selection keys PA for selecting one or another of the paper supplying portions A and B, Print key PR for inputting the start command for the copying operation, and solenoid 28 for driving the pair of guide panels 6 and 7 are respectively connected to the controller 100. Although particulars have been abbreviated in this description, the controller is also connected to the transfer charger 3, separation charger 8, eraser lamp 11, charger 12, main motor and the like. The copying operation is executed by actuating the aforesaid elements with predetermined timing.

Control of the aforesaid operation is described hereinafter by way of examples with reference to the accompanying FIGS. 8 through 12.

Figure 8:
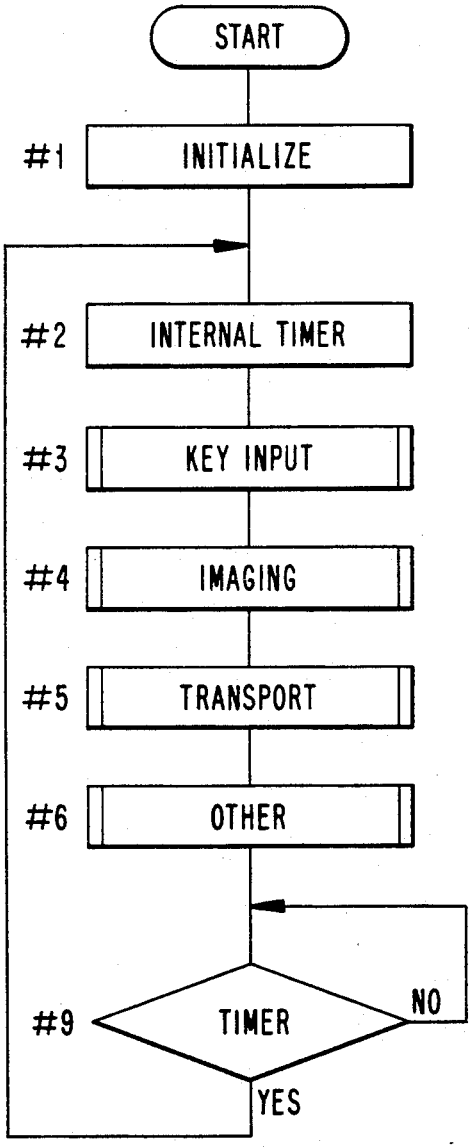
FIG. 8 is a flow chart of the main routine showing the sequence of operational controls.

FIG. 8 is a flow chart showing the main control routine. Other processes accompanying the main processes are executed at initialization (step #1), and thereafter the internal timer that regulates the time period of a single routine of the main control is started (step #2). Then, the various subroutines of the key input process, developing process, sheet transporting process, and other processes are sequentially executed (steps #3 to #6), after which the completion of the internal timer is awaited (step #9), then the routine returns to step #2 and the routines of steps #2 through #9 are repeated.

Figure 9:
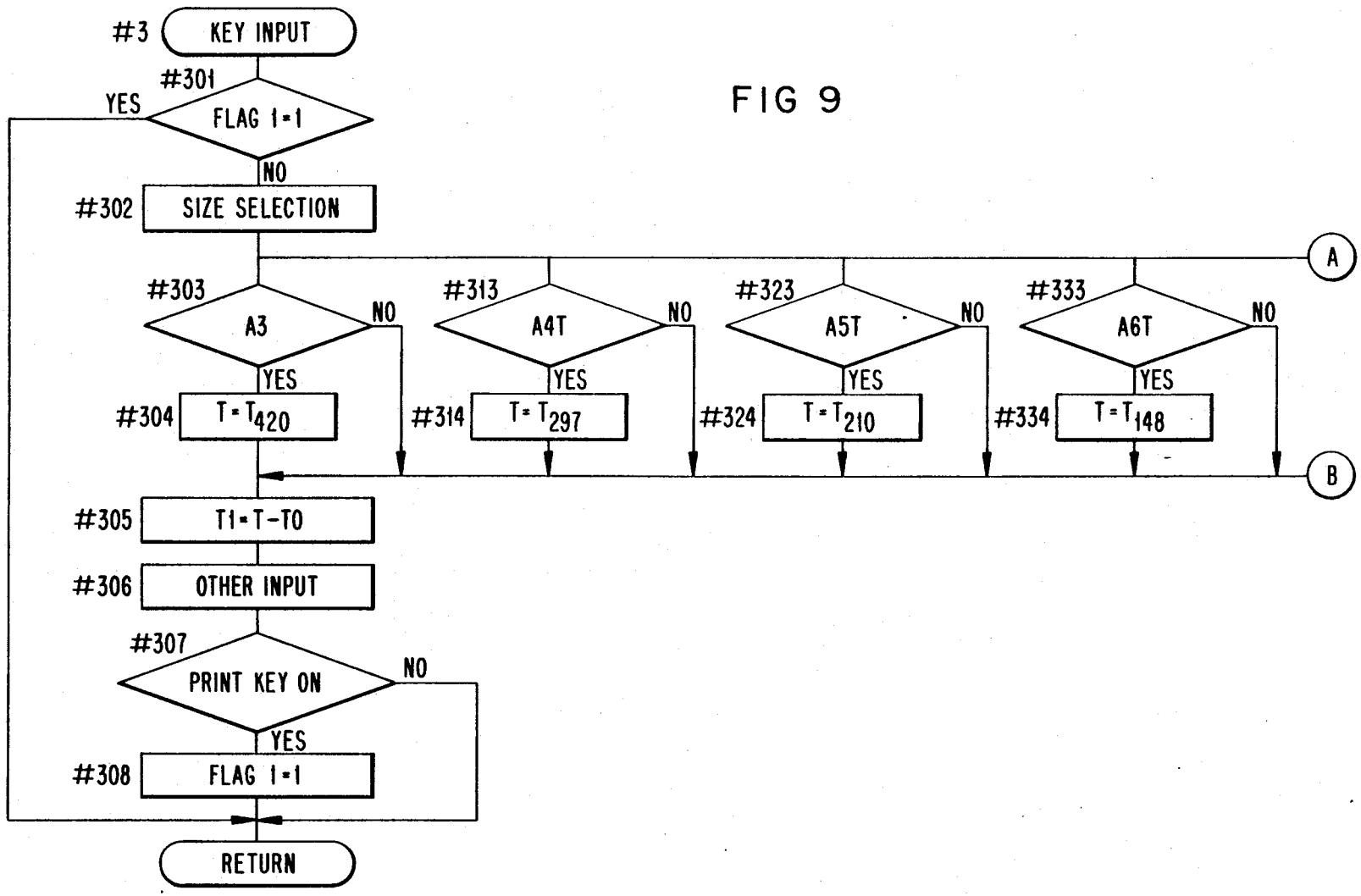
FIG. 9 is a flow chart showing the key input subroutine.
Figure 10:
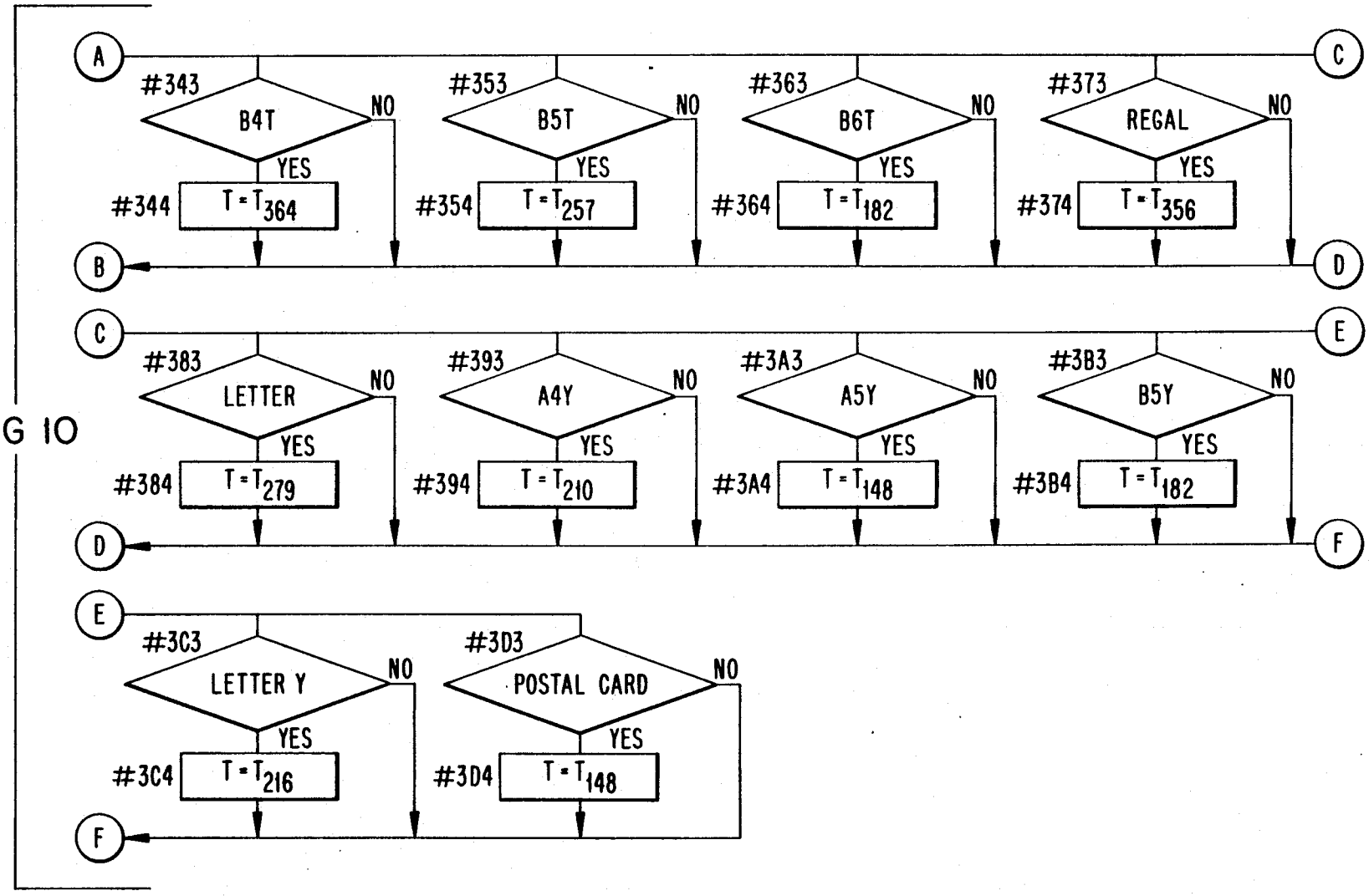
FIG. 10 is a flow chart showing the key input subroutine.

FIGS. 9 and 10 show the flow chart for the key input subroutine. The copy sheet 2 size selection is executed (steps #301 and #302) when it has been determined that the flag 1 is not set at [1], namely, the print key is not switched on. At this time, the routine branches among the steps #303, #313, #323, #333, #343, #353, #363, #373, #383, #393, #3A3, #3B3, #3C3, #3D3 in accordance with the selected sheet size, and the timer value for the sheet passage interval was set at time T in accordance with the respective sheet size (steps #304, #314, #324, #334, #344, #354, #364, #374, #384, #394, #3A4, #3B4, #3C3, #3D3).

Then, the value $T_0$ is subtracted from the timer value T, and set as timer $T_1$. The value $T_0$ regulates the time period for moving the pair of guide panels 6 and 7 from the extended state to the contracted state and the passage of a position of the copy sheet 2 about 50 mm from the leading end thereof through the timing rollers 5.

Thereafter, subsequent input processes are executed, and the flag 1 is set at [1] when the print key is depressed (steps #306 to #308).

Figure 11:
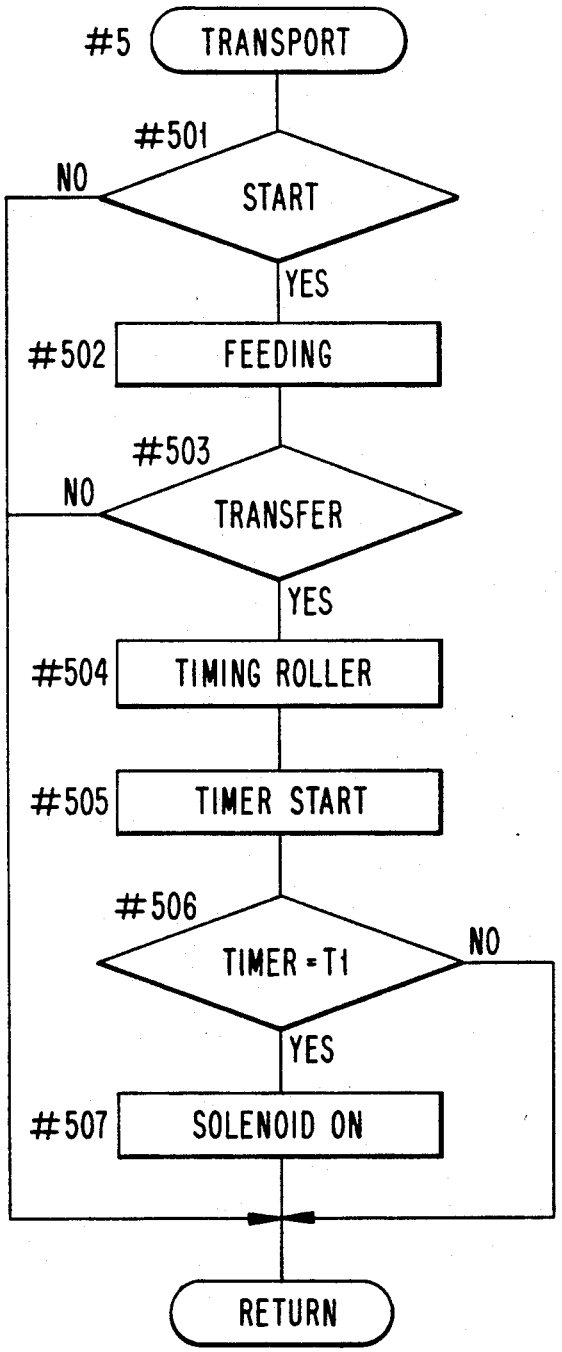
FIG. 11 is a flow chart showing the sheet transport process subroutine.
Figure 12:
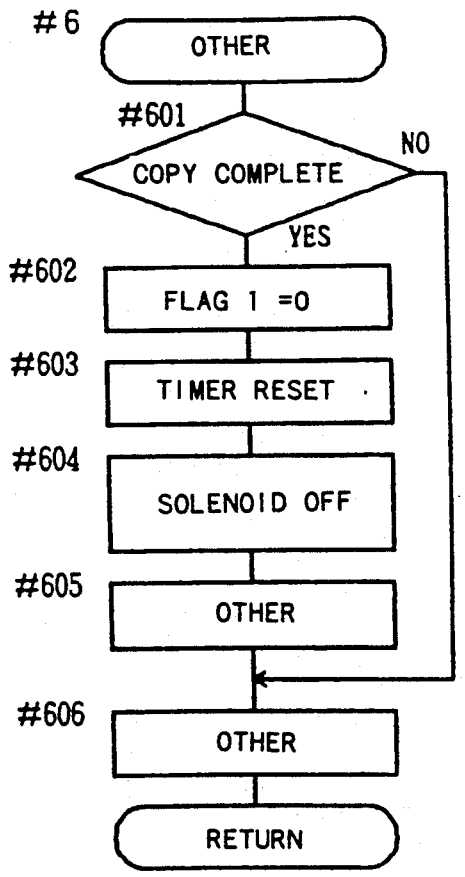
Figure 13:
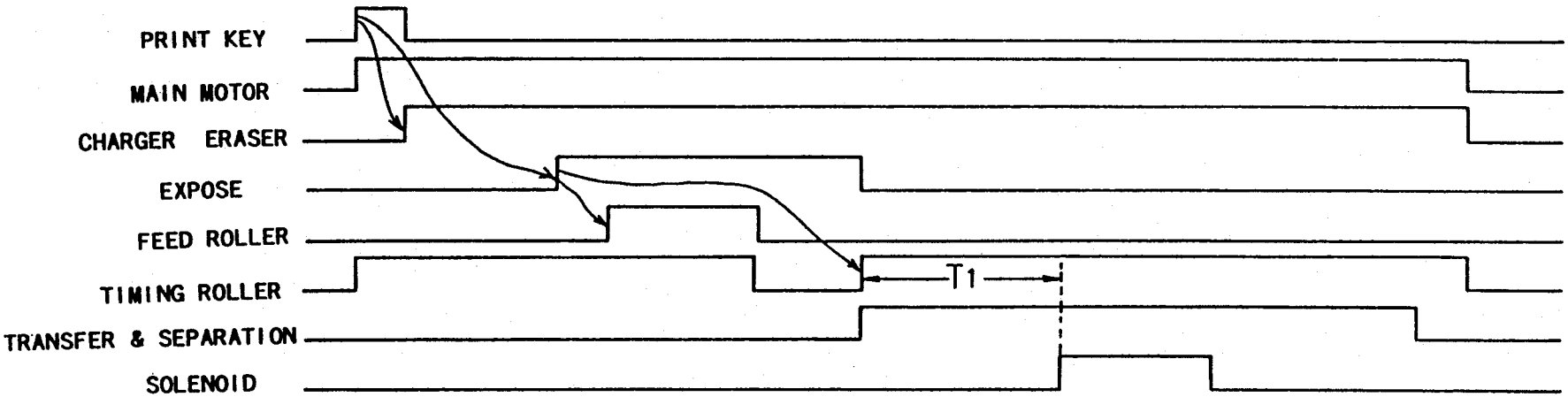
FIG. 13 is a time chart showing the operation timing of the main elements.

FIG. 11 is a flow chart showing the sheet transport process subroutine of FIG. 8. The sheet feeding process is executed if the sheet feed start timing is specified (steps #501 and #502). When the transfer start timing is set, the timing rollers 5 are actuated (steps #503 and #504), and the timer T1 is started (step #505). After the set timer interval of the timer T1 has elapsed, the solenoid 12 is switched on (steps #506 and #507). Accordingly, the leading end of the copy sheet 2 advances between the pair of guide panels 6 and 7 located in the extended states shown in FIGS. 3 and 4 and moves toward the transfer station via the start of actuation of the timing rollers 5. The pair of guide panels 6 and 7 retract from the extended state to the contracted state when a position about 50 mm from the trailing end of the copy sheet 2 is at the position of the timing rollers 5.

Figure 12:
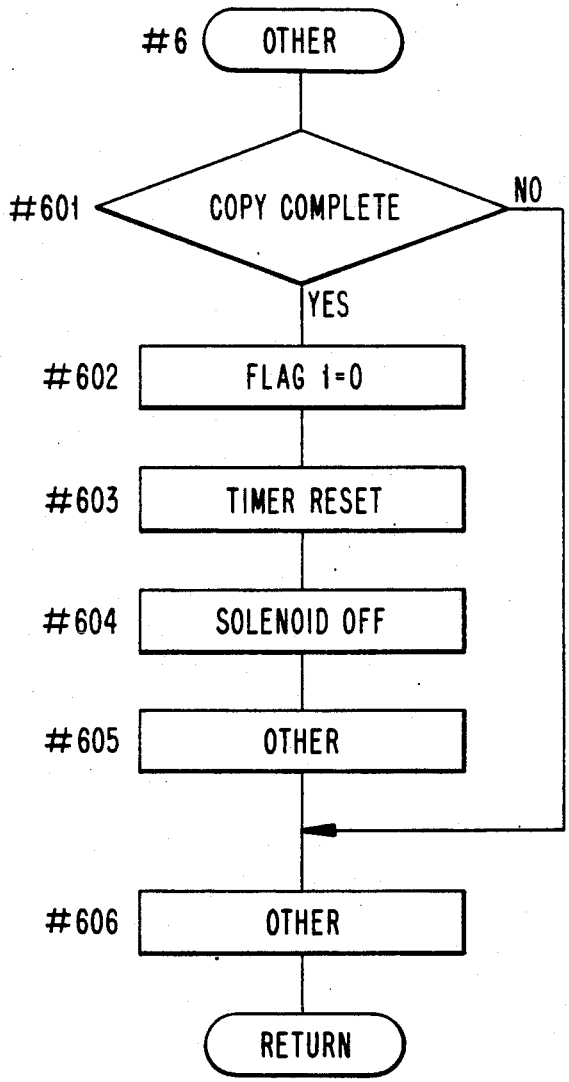
FIG. 12 is a flow chart showing other subroutines.

FIG. 12 is a flow chart showing the subroutines of other processes. The completion of the copy operation is awaited, and when completed the flag 1 is reset to [0] and the timer T1 is also reset (steps #601 through #603). Next, the solenoid 12 is switched off (step #604), which returns the pair of guide panels 6 and 7 to the extended state for feeding the next copy sheet 2 so as to not obstruct the passage of the next sheet. Other processes are executed as required in accordance with the stage wherein the aforesaid operation has been completed but the copy operation has not been completed in step #601, then the program returns (steps #605 and #606).

A time chart of the main operations described above is shown in FIG. 13.

The prevention of the undulations when the trailing end of the copy sheet 2 is separated from the timing rollers 5 is mainly accomplished by the upper guide panel 6. Accordingly, substantially the same effectiveness as that provided by the aforesaid embodiment may be accomplished by having the lower guide panel 7 fixedly mounted in the extended state while the upper guide panel 6 alone is driven in both the extended state and the contracted state.

Figure 14:
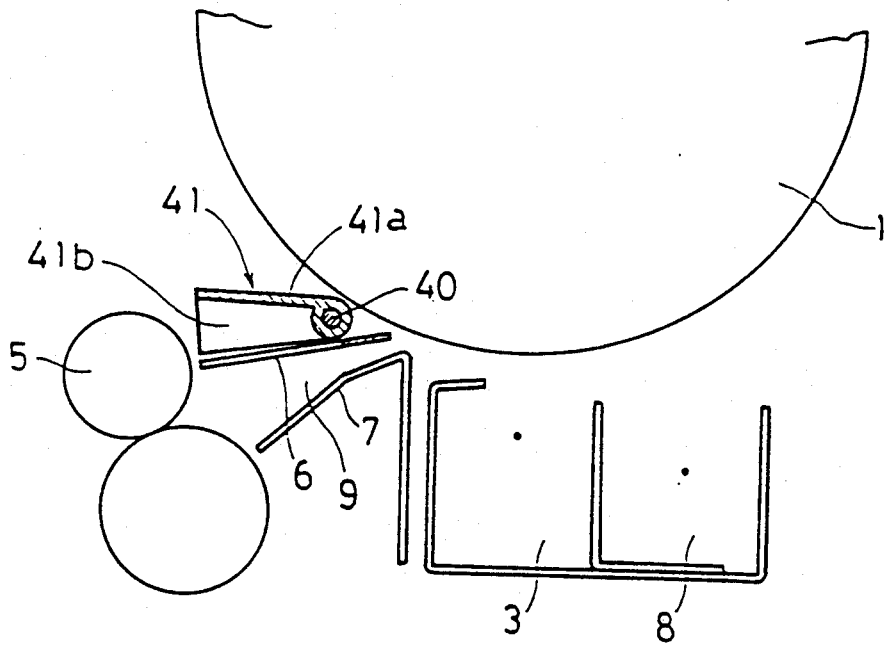
FIG. 14 is an illustration showing the extended state of the second embodiment of the guide means.
Figure 15:
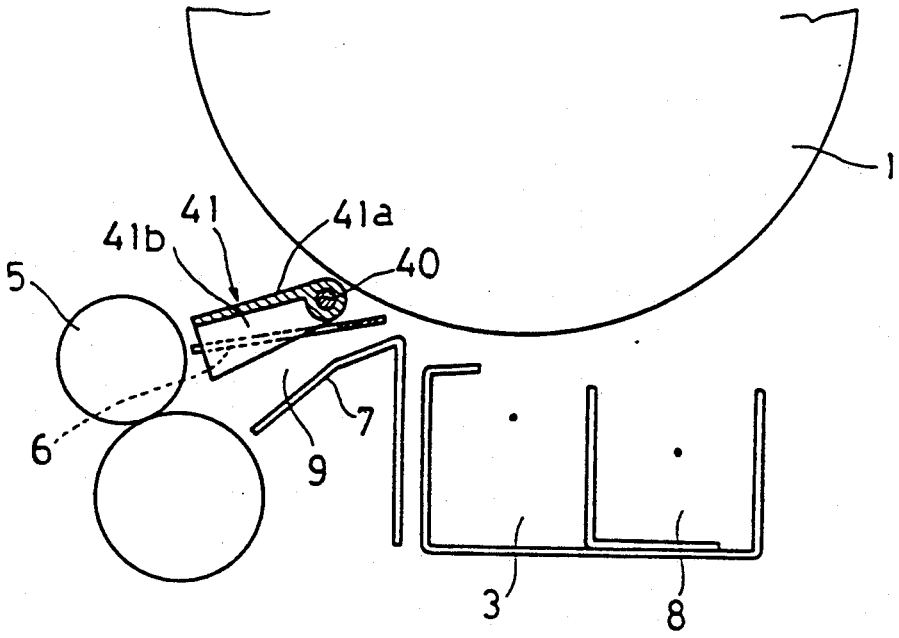
FIG. 15 is an illustration showing the contracted state of the second embodiment of the guide means.
Figure 16:
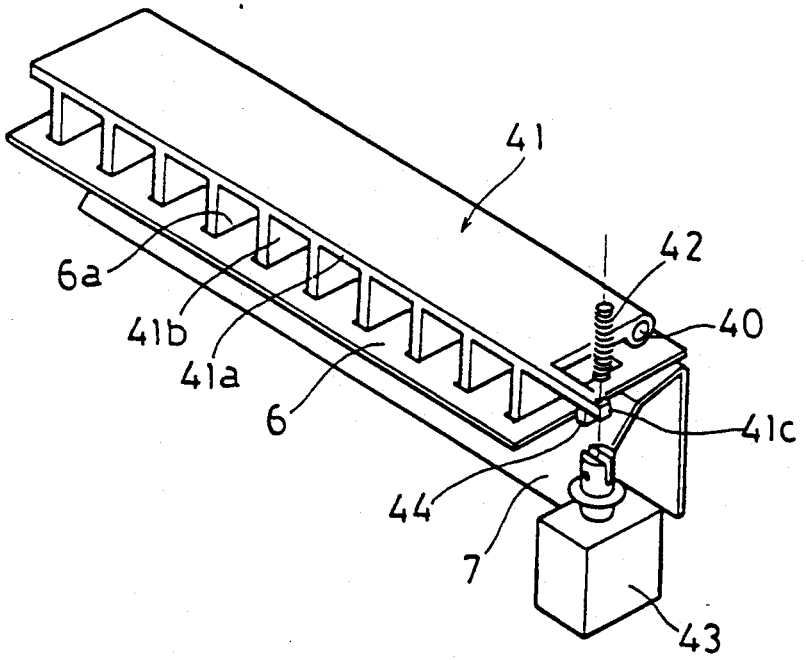
FIG. 16 is a perspective view showing the construction of the second embodiment of the guide means.

A second embodiment of the present invention is shown in FIGS. 14 through 16. Both the upper guide panel 6 and the lower guide panel 7 fixedly mounted, and a supplementary guide 41 is provided between the upper guide panel 6 and the rear thereof and can intrude into and retract from the transport path 9. The transport path 9 can be partially extended and contracted by the intrusion and retraction of the supplementary guide 41 to achieve substantially the same effect as that accomplished by the first embodiment.

The supplementary guide 41 is rotatably supported in the base portion **41*a* thereof by a shaft 40 downstream in the sheet transport direction. On the inner surface of the base portion 41*a* are provided a plurality of guide ribs 41*b* formed as a unit parallel to the sheet transport direction. These guide ribs 41*b* pass through a plurality of slits 6*a* formed in the upper guide panel 6 opposite said guide ribs 41*b* so as to intrude into and retract from the transport path 9. A spring 42 and a solenoid 43 are connected to an armature 41*c* protruding from one side of the supplementary guide to effect the aforesaid intrusion and retraction. When the solenoid is off, the supplementary guide 41 is held in the retracted position from the transport path 9 of FIG. 14 by the force applied by the spring 42. When the solenoid is on, the supplementary guide 41 moves to intrude into the transport path 9 of FIG. 15 against the force of the spring 42. The aforesaid intruding position is regulated by the stopper 44** to prevent excessive intrusion.

FIG. 14 shows the supplementary guide 41 in the retracted state wherein the pair of guide panels 6 and 7 maintain the same spacing as the extended state of the first embodiment, which allows the leading end of the copy sheet 2 to be smoothly guided without being snagged even given variations in the direction of the leading end of the sheet 2 being sent from the timing rollers 5. Accordingly, the effectiveness of the present arrangement is comparable to the extension state of the first embodiment.

In the extended state shown in FIG. 15 wherein the guide ribs **41*b* of the supplementary guide 41 intrude into the transport path 9, the rebound of the trailing end of the copy sheet 2 separated from the timing rollers 5 is regulated by the guide ribs 41*b***. Accordingly, the effectiveness is substantially the same as that achieved by the contraction of the transport path of the first embodiment.

In the present embodiment, the upper guide panel 6 may be omitted when the copy sheet 2 can be sufficiently guided by means of the guide ribs **41*b*of the supplementary guide 41**. Similarly, the construction of the pair of guide means may be variously modified.

What is claimed is:

1. A sheet guiding apparatus for guiding a copy sheet sent from a pair of feed rollers to a transfer station of an image forming apparatus, said sheet guiding apparatus comprising:

first guide means for acting on a first surface of the copy sheet sent from the pair of feed rollers and guiding the copy sheet to the transfer station;

second guide means, confronting said first guide means, for acting on a second surface of the copy sheet sent from the pair of feed rollers and guiding the copy sheet to the transfer station;

support means for supporting said first guide means movable from a first position to a second position, the distance between said first guide means at the second position and said second guide means is narrower than the distance between said first guide means at the first position and said second guide means;

drive means for moving said first guide means between said first position and said second position; and control means for controlling said drive means such that said first guide means locates at said first position when the leading end of the copy sheet is coming toward an interval between said first guide means and second guide means and that said first guide means locates at said second position while the trailing end of the copy sheet is passing through the interval between said first and second guide means.

2. The sheet guiding apparatus as claimed in claim 1, wherein said pair of feed rollers feeds the sheet along a common tangential line of the pair of feed rollers, the common tangential line passing through a nip portion of the feed rollers; and said first guide means has a first guiding surface which acts on the first surface of the copy sheet, said first guiding surface of said first guide means being substantially parallel to the tangential line of the pair of feed rollers when said first guide means is located at said second position.

3. The sheet guiding apparatus as claimed in claim 1, wherein said control means controls said driving means in accordance with the size of the copy sheet.

4. The sheet guiding apparatus as claimed in claim 3 further comprising:

size detecting means for detecting the size of the copy sheet to be fed and generating a size signal representing the size of the copy sheet to be fed.

5. The sheet guiding apparatus as claimed in claim 4, wherein said control means controls said driving means in accordance with the size signal generated by said detecting means.

6. The sheet guiding apparatus as claimed in claim 1, further comprising:

second support means for supporting said second guide means movable from a third position to a fourth position, the distance between said second guide means at the third position and said first guide means is narrower than the distance between said second guide means at the fourth position and said first guide means.

7. The sheet guiding apparatus as claimed in claim 6, wherein said drive means drives said second guide means between said third position and the fourth position.

8. The sheet guiding apparatus as claimed in claim 7, wherein said control means for controlling said drive means is such that said second guide means locates at said fourth position when the leading end of the copy sheet is coming toward the interval between said first guide means and second guide means and that said second guide means locates at said third position while the trailing end of the copy sheet is passing through the interval between said first and second guide means.

9. A sheet guiding apparatus for guiding a copy sheet sent from a pair of feed rollers to a transfer station of an image forming apparatus, said sheet guiding apparatus comprising:

first and second guide means for guiding the copy sheet fed from the pair of feed rollers to the transfer station, the feeding direction of the copy sheet being changed from a line tangential to a direction of the pair of feed rollers to a direction of the transfer station by said guide means;

support means for supporting said guide means movable from a first position to a second position, the distance between said first guide means at the second position and said tangential line is less than the distance between said first guide means at the first position and the second guide means;

drive means for moving said guide means between said first position and the second position; and control means for controlling said drive means such that said guide means locate at said first position when the leading end of the copy sheet is coming toward said guide means and that said guide means locate at said second position while the trailing end of the copy sheet is passing through said guide means.

10. The sheet guiding apparatus as claimed in claim 9, wherein said pair of feed rollers feeds the sheet along the tangential line of the pair of feed rollers, the tangential line passing though the nip portion of the feed rollers; and said first guide means has a first guiding surface which acts on a first surface of the copy sheet, said first guiding surface of said first guide means being substantially parallel to the tangential line of the pair of feed rollers when said first guide means is located at said second position.

11. The sheet guiding apparatus as claimed in claim 10, further comprising:

size detecting means for detecting the size of the copy sheet to be fed and generating a size signal representing the size of the copy sheet to be fed.

12. The sheet guiding apparatus as claimed in claim 11, wherein said control means controls said driving means in accordance with the size signal generated by said size detecting means.

13. The sheet guiding apparatus as claimed in claim 9, wherein said control means controls said driving means in accordance with the size of the copy sheet.

14. An image forming apparatus for forming an image on a copy sheet, said apparatus comprising:

a photosensitive member;

means for forming a toner image on said photosensitive member;

means for feeding a copy sheet from a paper stack toward said photosensitive member, said feeding means including a pair of feed rollers;

means, provided at a transfer station, for transferring the toner image from said photosensitive member onto the copy sheet fed by said feeding means;

first guide means, provided between said pair of feed rollers and said transfer station, for acting on a first surface of the copy sheet sent from the pair of feed rollers and guiding the copy sheet to the transfer station;

second guide means, confronting said first guide means, for acting on a second surface of the copy sheet sent from the pair of feed rollers and guiding the copy sheet to the transfer station;

support means for supporting said first guide means movable from a first position to a second position, the distance between said first guide means at the second position and said second guide means is narrower than the distance between said first guide means at the first position and said second guide means;

drive means for moving said first guide means between said first position and the second position; and control means for controlling said driving means such that said first guide means locates at said first position when the leading end of the copy sheet is coming toward an interval between said first guide means and second guide means and that said first guide means locates at said second position while the trailing end of the copy sheet is passing through the interval between said first guide means and the second guide means.

15. The image forming apparatus as claimed in claim 14, wherein said pair of feed rollers feeds the copy sheet along a common tangential line of the pair of feed rollers, the common tangential line passing through a nip portion of the feed rollers; and said first guide means has a first guiding surface which acts on the first surface of the copy sheet, said first guiding surface of said first guide being substantially parallel to the tangential line of the pair of feed rollers when said first guide means is located at said second position.

16. The image forming apparatus as claimed in claim 15, wherein said control means controls said driving means in accordance with the size of the copy sheet.

17. The image forming apparatus as claimed in claim 16, further comprising:

size detecting means for detecting the size of the copy sheet to be fed and generating a size signal representing the size of the copy sheet to be fed.

18. The image forming apparatus as claimed in claim 14, further comprising:

second support means for supporting said second guide means movable from a third position to a fourth position, the distance between said second guide means at the third position and said first guide means is narrower than the distance between said second guide means at the fourth position and said first guide means.

19. The image forming apparatus as claimed in claim 18, wherein said control means controls said driving means in accordance with the size signal generated by said size detecting means.

20. The image forming apparatus as claimed in claim 18, wherein said drive means drives said second guide means between said third position and the fourth position.

21. The image forming apparatus as claimed in claim 20, wherein said control means controls said drive means such that said second guide means locates at said fourth position when the leading end of the copy sheet is coming toward the interval between said first guide means and second guide means and that said second guide means locates at said third position while the tailing end of the copy sheet is passing through the interval between said first and second guide means.

22. An image forming apparatus for forming an image on a copy sheet, said apparatus comprising:

a photosensitive member;

means for forming a toner image on said photosensitive member;

means for feeding a copy sheet from one of a plurality of paper stacks toward said photosensitive member;

means for selecting one of the plurality of paper stacks;

means for generating a size signal corresponding to the size of the copy sheets stacked in the paper stack selected by the selecting means;

means, provided at the transfer station, for transferring the toner image from said photosensitive member onto the copy sheet fed by said feeding means;

first and second guide means, provided between said feeding means and said transfer station, for guiding the copy sheet sent from the feeding means to the transfer station;

support means for supporting said guide means movable from a first position to a second position;

drive means for moving said first guide means between said first position and said second position; and control means for controlling said drive means in accordance with the size signal.

23. The image forming apparatus as claimed in claim 22, wherein said control means controls the driving means such that said first guide means locates at said first position when the leading end of the copy sheet is coming toward said guide means and that said guide means locates at the second position while the trailing end of the copy sheet is passing through said first and second guide means.

* * * * *